United States Patent [19]

Pardue, Jr.

[11] Patent Number: 4,910,931

[45] Date of Patent: Mar. 27, 1990

[54] WATER COLLECTION AND DRAINAGE SYSTEM FOR MASONRY BLOCK WALLS

[76] Inventor: Leonard C. Pardue, Jr., 3511 SW. Iowa, Portland, Oreg. 97221

[21] Appl. No.: 304,779

[22] Filed: Jan. 31, 1989

[51] Int. Cl.[4] ..... E02D 19/00; E04D 17/00

[52] U.S. Cl. ..... 52/169.5; 52/303; 405/36; 405/229

[58] Field of Search ..... 52/169.1, 169.5, 169.14, 52/12, 14, 16, 302, 303, 503–505, 606–609; 405/36, 43, 45, 229

[56] References Cited

U.S. PATENT DOCUMENTS

| | | | |
|---|---|---|---|
| 1,746,816 | 2/1930 | Boes | 52/303 X |
| 1,954,730 | 4/1934 | Erickson | 52/303 |
| 2,147,035 | 2/1939 | Henderson | 52/303 X |
| 2,298,319 | 10/1942 | Vatet | 52/303 X |
| 2,329,585 | 9/1943 | Brewer | 52/308 |
| 2,530,940 | 11/1950 | Dahlin | 52/303 X |
| 2,934,931 | 5/1960 | Johnson | 52/303 |
| 3,287,866 | 11/1966 | Bevilacqua | 52/169.5 |
| 3,293,810 | 12/1966 | Cox et al. | 52/303 |
| 3,562,982 | 2/1971 | Parezo | 52/169.5 |
| 3,668,829 | 6/1972 | Nelson | 52/169.5 |
| 3,852,925 | 12/1974 | Gazzo | 52/169.5 |
| 4,333,281 | 6/1982 | Scarfone | 52/169.5 |
| 4,381,630 | 5/1983 | Koester | 52/169.5 |
| 4,486,986 | 12/1984 | Cosenza | 52/169.5 |
| 4,612,742 | 9/1986 | Bevilacqua | 52/169.5 |

*Primary Examiner*—Richard E. Chilcot, Jr.

*Attorney, Agent, or Firm*—Klarquist, Sparkman, Campbell, Leigh & Whinston

[57] ABSTRACT

A water collection and drainage system is described for a masonry block wall having bond beam block courses and intervening standard block courses. A system of upper water collection pans is supported along each upper bond beam course. Downspouts leading from drain openings in the upper collection pans drain collected water from the pans through the vertical block cavities in lower block courses to the next lower series of collection pans. The lowermost bond beam course supports a series of base collection pans which collect water drained through the vertical block cavities from the upper collection pans. Weeping spouts lead laterally from the base collection pans to the exterior of the wall to continuously drain collected water from the interior wall cavities.

18 Claims, 3 Drawing Sheets

FIG. 1
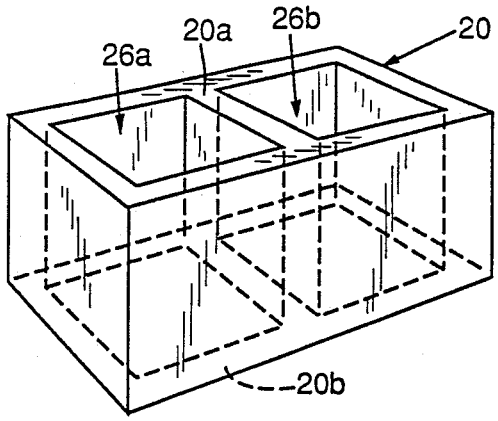
FIG. 2
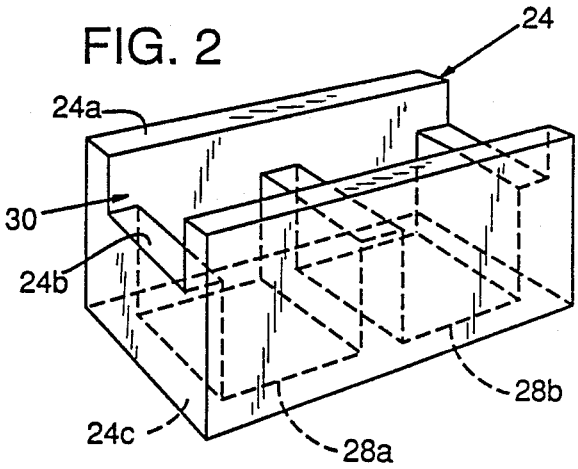
FIG. 6
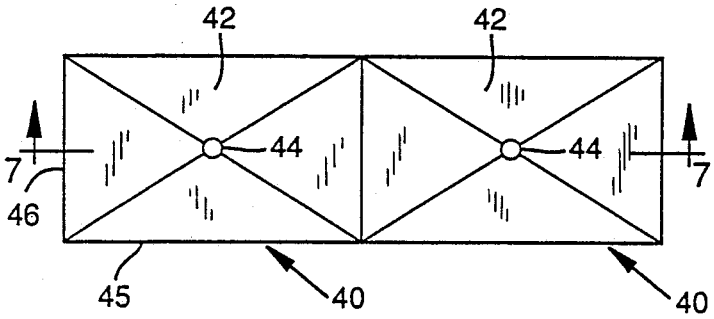
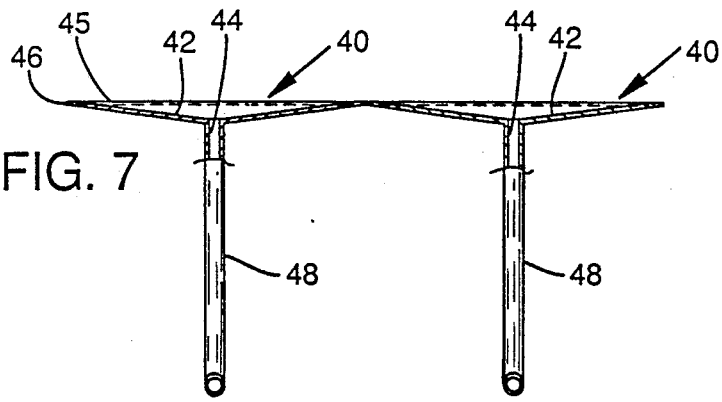
FIG. 7
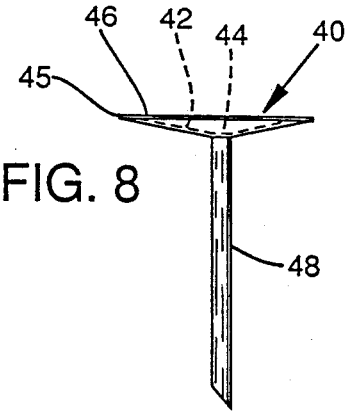
FIG. 8

WATER COLLECTION AND DRAINAGE SYSTEM FOR MASONRY BLOCK WALLS

BACKGROUND OF THE INVENTION

This invention relates to systems for preventing water from passing from the exterior of a block wall to the inside of a building. More specifically, the invention relates to a drainage system especially for collecting seepage water in and draining it from the interior cavities of a masonry block wall back to the outside of the wall.

For years, construction contractors have struggled with the problem of building a water-tight wall of masonry blocks. Masonry block walls are notorious for allowing water on the exterior side of the wall to enter into its central cavities through the joints between the blocks, or through the blocks themselves. Once water has entered into the block cavities, it tends to seep inside the building and cause moisture problems. Water within the blocks and on their surfaces damages interior and exterior wall finishes.

Elastomeric sealants are sometimes used to try to seal the outer surfaces of block walls. However, such sealants are not entirely effective, are expensive to apply, and obscure the natural appearance of the blocks where a natural look is desired.

There have been several other attempts to solve the problem of water seepage through masonry block walls. For example, some have tried using blocks in the bottom course that have openings to drain the water from inside the block cavities to a gravel bed, and subsequently into a drain tile. Examples of this type of system are shown in U.S. Pat. No. 4,612,742 to Bevilacqua, U.S. Pat. No. 4,333,281 to Scarfone, U.S. Pat. No. 3,852,925 to Gazzo, and U.S. Pat. No. 3,287,866 to Bevilacqua.

Others have tried to solve such problem by placing blocks at the bottom course that have interconnecting lateral slots which allow the water to drain laterally into an adjacent block. The water then drains to the exterior of the block wall by either a drain pipe extending from one of the blocks, as shown in U.S. Pat. No. 3,562,982 to Parezo, or by openings in the bottom course blocks which direct the water to a gravel bed and subsequently to a drain tile, as shown in U.S. Pat. No. 4,486,986 to Cosenza.

Still others have tried to solve the problem by placing a thin vent structure beneath the bottom block course to draw the water toward a gravel bed, which then directs the water to a drain tile. Such a system is shown in U.S. Pat. No. 4,381,630 to Koester.

One drawback of the above-mentioned drainage systems is that they do not prevent water within the block cavities from contacting and seeping through the walls of the interior block cavities as it drains down through such cavities. Water passing from upper courses to lower courses must run down the walls of the interior cavity, causing such walls to become saturated with water, which eventually seeps to the interior and exterior surfaces of the building.

Another drawback of previous drainage systems is that they drain water toward the inside of the building, rather than directing it to the exterior of the building. Such systems promote saturation of the ground underneath the wall and building structure, are difficult to install, and make access to the gravel bed and drain tile difficult.

Another major problem with previous drainage systems is that water tends to accumulate on top of the footing before it drains through holes in the block to the gravel bed. As tee water accumulates on top of the footing, it seeps through joints and cracks in the footing, which causes water to pass to the inside of the building.

Still another problem with prior drainage systems is that they do not collect water from the block cavities at a level other than the bottom course. Consequently, water that has entered a block wall at upper courses must run down the walls of the interior cavities to the bottom course before it drains. In doing so, water inherently contacts and seeps through the blocks to the inside of the building.

A primary object of the present invention, therefore, is to provide an effective water collection and drainage system and method for a masonry block wall which prevent water from passing from the exterior to the interior side of the wall by controlling and directing water flow within the wall.

Another object is to provide a water collection and drainage system and method which collect and remove water from interior cavities of a masonry block wall to the exterior of the wall.

Additional objects are to provide a water collection and drainage system which is easy to install during construction of a masonry block wall, and which is simple and inexpensive to manufacture.

Still another object is to provide a collection and drainage system and method which prevent water from accumulating at the top of a footing.

Another object is to provide a water collection and drainage system and method which collect water at several different levels of a block wall, direct it down through the interior cavities of the wall to a lower collection level, and finally direct it to the outside of the wall at such lower level.

Yet another object of the invention is to provide a water collection and drainage system and method which prevent water in upper interior cavities from draining down interior cavity walls to be absorbed by lower level blocks.

SUMMARY OF THE INVENTION

The present invention is a water collection and drainage system and method which collect water at predetermined locations within the interior of the wall, then direct the collected water to discharge points within the wall, and finally channel the water back to the outside of the wall, preferably at or near its base.

Preferably, water that has seeped into a block wall is collected at different wall levels in collection pans The water collected at upper wall levels is drained through interior block cavities and collected at lower wall levels, and so on, until all water is finally collected in base collection pans which drain the collected water to the outside of the wall through weep tubes.

If the wall is a masonry wall made up of bond beam block courses and intervening standard block courses, the upper collection pans may be located at bond beam courses and drain collected water through downspouts leading into the interior cavities of lower standard block courses. The base collection pans may be located at the lowermost, or base, bond beam course, with their weep spouts or tubes leading to the exterior of the wall above its footing and ground level.

The foregoing objects, features, and advantages of the invention, which are by no means exclusive, will become more apparent from the following detailed description and accompanying drawings.

BRIEF DESCRIPTION OF THE DRAWINGS

FIG. 1 is a perspective view of a standard concrete block.

FIG. 2 is a perspective view of a bond beam concrete block.

FIG. 6 is a top plan view of an upper collection pan.

FIG. 7 is a front sectional view of the upper collection pan taken along the line 6—6 of FIG. 5.

FIG. 8 is an end sectional view of the upper collection pan taken along the line 8—8 of FIG. 6.

DETAILED DESCRIPTION OF A PREFERRED EMBODIMENT

Figure 3:
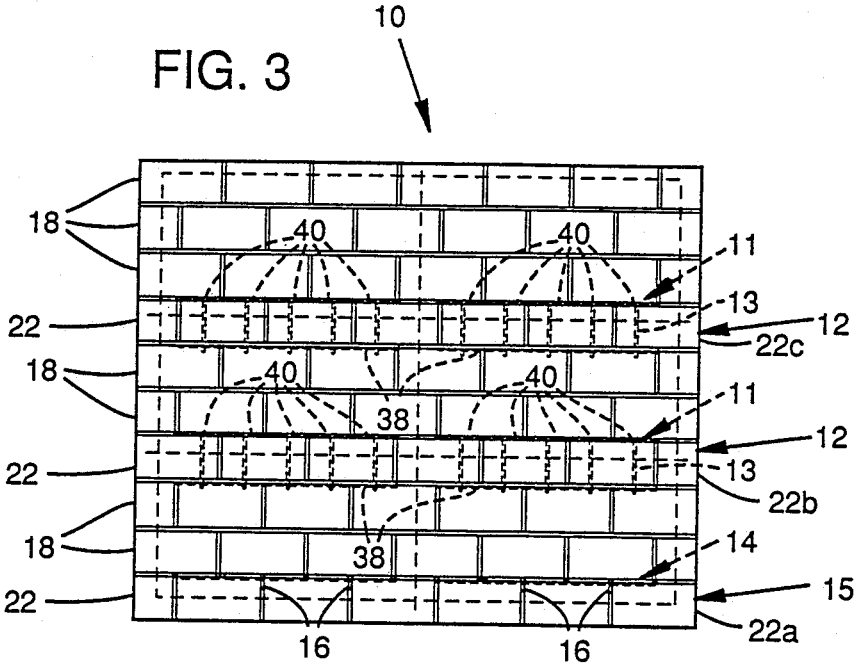
FIG. 3 is a wall elevation of a concrete block wall.
Figure 4:
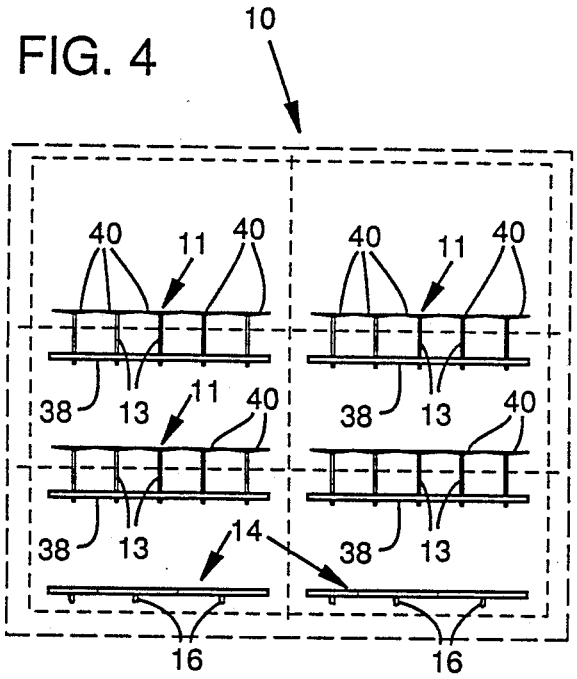
FIG. 4 is a schematic elevational view of the wall of FIG. 3 without the blocks being shown.

Referring first to FIGS. 3 and 4, the present invention involves a drainage system for removing water from interior cavities of a masonry or similar block wall 10 to the exterior of the wall. The system includes upper collection means 11 located at upper block courses 12 that collects water drained from interior block cavities above the upper block courses 12. A vertical drainage means 13 associated with each upper collection means directs the collected water to central portions of interior block cavities below the upper collection means. In addition, the drainage system includes a base collection means 14 located at a lower, or base, block course 15 that collects the water drained from the upper collection means through interior block cavities, and a lateral drainage means 16 (FIG. 5) associated with the base collection means that directs collected water to the exterior of the block wall.

The drainage system is adapted for use in a masonry block wall 10 made up of multiple courses 18 of standard concrete blocks 20 and intervening courses 22 of bond beam concrete blocks 24. The standard and bond beam blocks are shown in detail in FIGS. 1 and 2, respectively. The standard block 20 has a pair of through interior openings or cavities **26*a*, 26*b* extending from a top surface 20*a* to a bottom surface 20*b* of the block. The bond beam block 24 has a pair of interior openings or cavities 28*a*, 28*b* of the same size and shape as the corresponding cavities 26*a*, 26*b* of the standard blocks. A recess 30 extends downwardly from a top surface 24*a* of the block to an intermediate surface 24*b*. The recess also extends from end to end of the block. Vertical cavities 28*a*, 28*b* extend from intermediate surface 24*b* to a bottom surface 24*c***.

In the typical masonry block wall of FIG. 3, the standard blocks 20 form multiple intermediate standard courses 18. Bond beam blocks 24 form a bottom, or base, bond beam course **22*a* and two upper bond beam courses 22*b*, 22*c*. The three bond beam courses 22 are separated vertically by multiple standard courses 18**.

Figure 5:
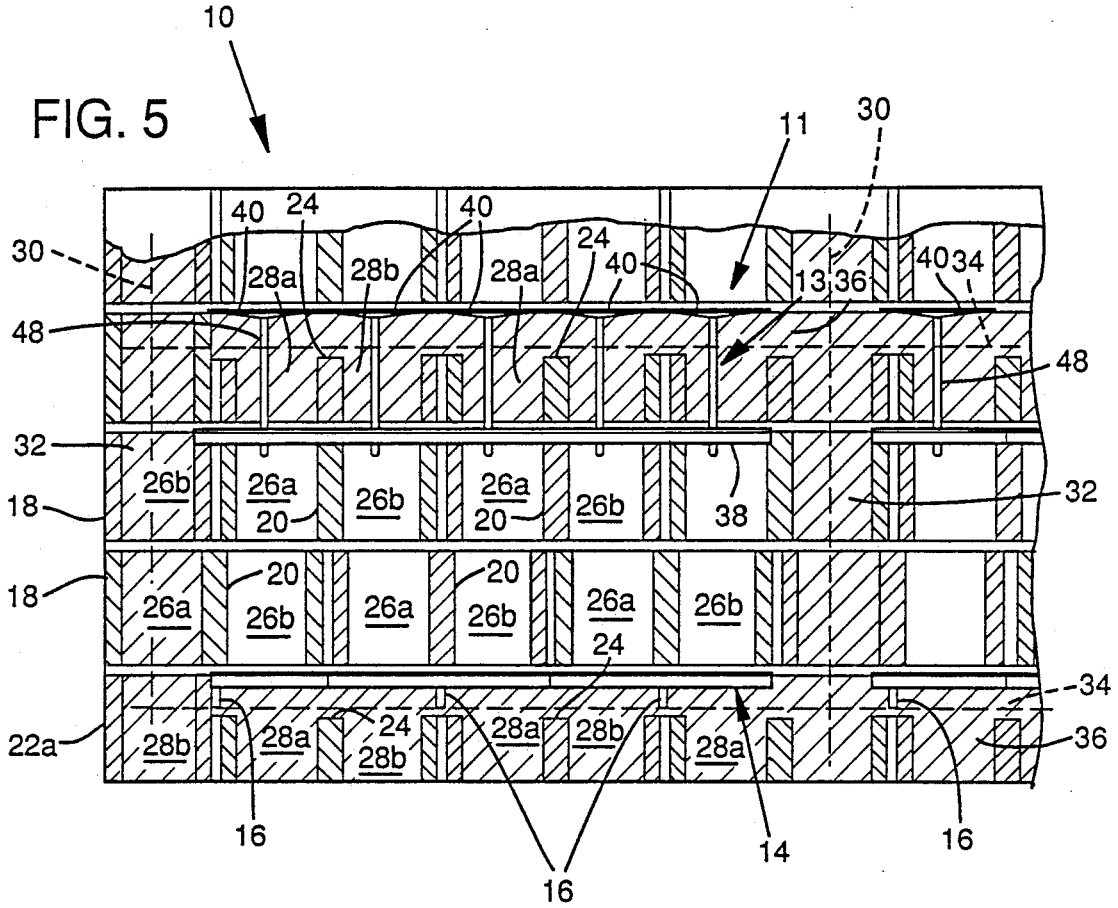
FIG. 5 is a vertical section through a mid-portion of the wall of FIG. 3, which reveals the central cavities of the blocks and the arrangement of the drainage system within the wall.

In constructing the wall 10 of FIG. 3, the standard and bond beam blocks are laid up in their respective courses 18, 20 so that the vertical openings 26, 28 through the blocks of vertically adjacent courses are vertically aligned, as shown in FIG. 5. That is, although the blocks of vertically adjacent courses may be staggered with respect to one another, their openings 26, 28 are aligned. This is true regardless whether the course is a bond beam course or a standard course. Therefore, the vertical openings through the blocks of the courses define through vertical interior wall cavities unless otherwise blocked in a manner to be described.

In typical masonry block wall construction, vertical steel reinforcing rods 30 are positioned within some of the vertical wall cavities formed by the block openings 26, 28. Then the cavities containing such rods are filled with concrete or grout to form vertical wall stabilizing columns 32.

The wall is also provided with lateral stability by placing horizontal reinforcing rods 34 in the horizontally aligned top recesses 30 of the bond beam blocks 24 of each bond beam course 22. Then both the recesses 30 and the vertical openings 26 of the bond beam blocks are filled with concrete or grout to form horizontal stabilizing beams 36. Additionally, a barrier 38, such as a thin sheet of metal, is placed between each bond beam course and the next lower standard course to prevent the concrete or grout placed in the bond beams while wet, from flowing down through the internal cavities of the standard blocks.

Thus far, the described masonry wall construction is conventional, except for the water collection and drainage means, which will now be described in greater detail.

As will be most apparent from FIGS. 3–5, the upper collection means 11 and associated vertical drainage means 13 are positioned at each of the upper bond beam courses **22*b*, 22*c* but not at the base bond beam course 22*a*. Instead, the base bond beam course supports the base collection means 14 and lateral drainage means 16**. These upper and base collection and drainage means are installed during construction of the wall, while the concrete or grout used to form the stabilizing beams and columns is still wet.

Each upper collection means 11 comprises a series of upper collection pans 40, shown in FIGS. 5, 6, and 7. The upper collection pans 40 may be interconnected in pairs, as shown best in FIGS. 6 and 7, or in other multiples. Each is sized to fit over a single cavity **28*a* or 28*b* to drain collected water down through that cavity. For this purpose, each collection pan has a generally rectangular, pyramidally shaped sloping collection surfaces 42 defining a shallow pan draining to a central bottom drain opening 44. Surfaces 42 slope downwardly and inwardly to opening 44 from marginal side and end edges 45, 46 defining the rectangular pan. The rectangular cross sectional area of each upper collection pan 40 is at least as great as the cross sectional area of the interior cavities of the overlying standard blocks 20. Thus, substantially all of the water draining downwardly from overlying interior block cavities above a collection pan 40** is collected in such pan.

The vertical drainage means 13 comprises, in addition to the central drain hole 44 through pan surface 40, a tubular downspout 48. Downspout 48 connects to the lowest point of pan surface 42 at its drain opening 44 to drain water from the pan to the center of the interior block cavities 26 below upper collection pan 40. The collected water from pan 40 thus drains through central drain hole 40 and downspout 48, to enter a lower vertical interior wall cavity. Because each downspout 48 is centered within the associated beam block cavity 28 (See FIG. 5), it drains water centrally into aligned standard block cavities 26 below the bond beam course, thereby preventing or at least minimizing contact of such drainage water with the interior wall cavities so that it can be collected at a lower point in the wall and eventually directed to the outside of the wall.

Each collection pan or series of such pans can be made of molded plastic, sheet metal, or other suitable material, as can the connected downspouts.

Figure 9:
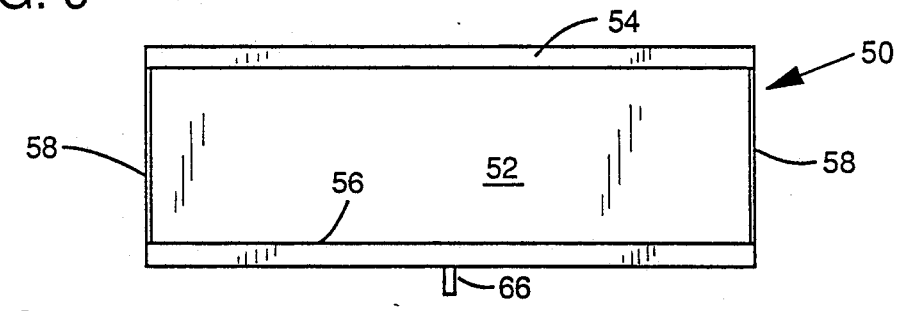
FIG. 9 is a top plan view of a base collection pan.
Figure 10:
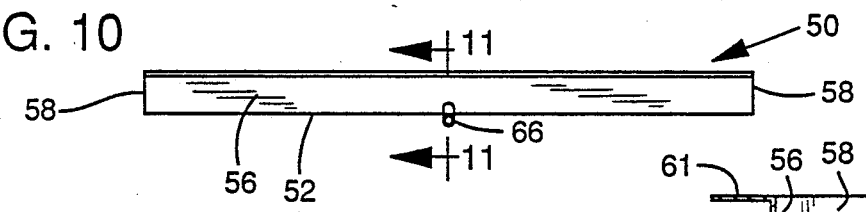
FIG. 10 is a front view of the base collection pan shown in FIG. 9.
Figure 11:
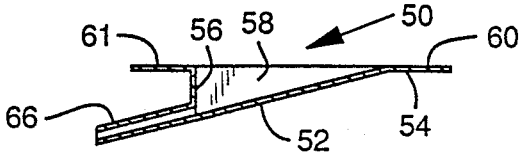
FIG. 11 is an end sectional view of the base pan of FIG. 10 taken along the line 11—11 of FIG. 10.

The base collection means 14 comprises a series of base collection pans 50. Each such pan 50, shown best in FIGS. 9–11, defines a trough-like pan having a bottom wall 52 sloping laterally and downwardly from a flanged side edge 54 to the bottom of an opposite side wall 56. The pan also includes opposite end walls 58. Side flanges 60, 61 provide means for supporting the pan on the upper surfaces 24*a* of the blocks 24 of the base bond beam course. Each pan as a length sufficient to span at least one overlying cavity 26 of overlying standard block courses. Preferably, such length is such that the pan spans several such cavities, as shown in FIG. 5. Each base collection pan includes at least one lateral drainage means 16 for draining the collected water from the pan to the outside of the wall at its base.

The lateral drainage means 16 comprises a lateral drain opening 64 through side wall 56 of the base collection pan 50 at the base of the side wall, that is, at the deepest part of the trough. In addition, the lateral drainage means comprises at least one lateral drain or weeping spout 66 for each pan. Each spout 66 connects to the base collection pan 50 at its drain opening 64 so that water collected in the pan drains out through opening 64 and spout 66 to the outside of wall 10. For this purpose, spout 66 slopes downwardly from drain opening 64 toward the outside of wall 10 when the base pan is properly installed on the base course of the wall.

With the base and upper collection pans and their associated drainage spouts installed as described, water seeping into or otherwise entering interior cavities of wall 10 is drained back to the outside of the wall before having a chance to penetrate to the inside wall surfaces. Water entering the wall above the uppermost bond beam course 22 eventually drains down through interior block cavities 26, 28 to the uppermost series of collection pans 40. From there, the water drains through downspouts 48 and the block cavities 26, 28 of lower block courses to the next series of upper collection pans 40. From there, the water continues along paths down through the wall defined by the downspouts and aligned interior wall cavities until the water reaches the series of base collection pans.

Of course, water entering the wall between its uppermost collection pans and its base collection pans also drains to the base collection pans in a similar manner. Such water is simply intercepted at a lower level of the wall by intermediate level collection pans 40 or by the base collection pans.

The drainage of water continues from the base collection pans through their drain holes and connected weeping spouts to the outside of the wall. The process may be continuous, never allowing water entering the wall from the outside to reach the inside wall surface.

Having illustrated and described the principles of my invention by what is presently a preferred embodiment, it will be appreciated that such embodiment may be modified without departing from such principles. I claim as my invention the preferred embodiment and all such modifications and equivalents within the spirit and scope of the following claims.

I claim:

1. A water drainage system for a masonry block wall having at least one set of courses, each set including an upper block course, a base block course, and an intermediate block course between the upper and base block courses, in which the courses are provided with an aligned vertically extending interior cavities, the drainage system comprising:

first water collection receptacle means extending along the upper block course of the wall and extending across the interior cavity of the upper course throughout the length of the cavity for collecting water flowing down a surface of a course facing said interior cavity above said first receptacle means and redirecting said water from said surface into said first receptacle means;

vertical drainage means associated with and located below said first water collection receptacle means for draining collected water from said first receptacle means through an interior cavity in the intermediate course below said first receptacle means to said base block course; and second water collection receptacle means extending along the base block course and extending across the interior cavity of said lower course throughout the length of said cavity below said vertical drainage means for collecting water drained through said vertical drainage means and conducting said collected water to the exterior of the wall.

2. A water drainage system according to claim 1 wherein said first water collection receptacle means comprises a substantially horizontally extending upper collection pan having a water collection surface area large enough to cover the cross-sectional area of the interior cavity across which the first water collection receptacle means extends.

3. A water drainage system according to claim 2 wherein each said upper collection pan is sized and shaped to cover an interior cavity in said upper course and includes a water collection surface sloping downwardly toward a drain hole located centrally in said surface.

4. A water drainage system according to claim 1 wherein said vertical drainage means comprises a drain opening in said first water collection receptacle means located centrally of said interior cavity for draining collected water from said first collection receptacle means, and means defining a vertical drain conduit extending downwardly from the drain opening for directing the flow of water downwardly centrally through said interior cavity in said intermediate course.

5. A water drainage system according to claim 1 wherein said second water collection receptacle means comprises a substantially horizontally extending base collection pan and means defining a lateral drain conduit extending from a drain opening in said base collection pan to the exterior of the wall, whereby water from said base collection pan is removed by gravity from said interior cavities.

6. A water drainage system according to claim 1 for a masonry block wall constructed of multiple courses of blocks, each block having at least one vertically extending interior cavity vertically aligned with a cavity of a block in the overlaying course and with a cavity of a block in the underlying course, wherein:

(a) said first water collection receptacle means substantially covers the vertically extending cavity of the block in said upper course along which said first receptacle means extends;

(b) said second water collection receptacle means substantially covers the vertically extending cavity of the block in said base course along which said second receptacle means extends; and (c) said vertical drainage means drains collected water from said first receptacle means through a vertically extending cavity of a block in said intermediate course, said interior cavity vertically aligned with said first and second receptacle means.

7. A water drainage system according to claim 6 wherein said upper and base block courses comprise courses of bond beam blocks, said first water collection receptacle means being positioned on top of an upper course of bond beam blocks, and said second water collection receptacle means being positioned on top of a base course of bond beam blocks.

8. A water drainage system according to claim 1 wherein the wall comprises multiple upper block courses each separated from a corresponding base course by at least one intermediate block course, there being at least one first water collection means at each of said upper block course and corresponding vertical drainage means through each of said intermediate courses.

9. A base collection pan for use in a water drainage system for a masonry block wall having an upper course of masonry blocks, a base course of masonry blocks, and at least one intermediate course of masonry blocks between the upper and base courses, the upper, intermediate, and base courses having at least one vertically aligned and vertically extending interior cavity defining an uninterrupted vertical passage from the bottom of the upper course to the top of the base course, said base collection pan comprising:

means defining a trough for positioning in said vertical cavity in said base course, for receiving water draining through said vertical cavity, and for preventing said received water from contacting surfaces of said blocks defining said cavity;

said trough having first and second side edges, each of which having flange means extending outwardly therefrom for mounting said trough in said cavity on the base course; and means for draining water by gravity from the trough including a drain conduit means extending outwardly and downwardly from a drain opening in said trough for draining water to the exterior of the block wall.

10. A base collection pan according to claim 9 wherein said trough is defined by a bottom panel and a side panel, said bottom panel sloping downwardly from said first side edge to a second side edge, intersecting a lower edge of the side panel to form a deepest portion of said trough;

said drain opening being located along the intersection of said side and bottom panels.

11. An upper water collection pan for use in a water drainage system for a masonry block wall having an upper course of masonry blocks, a base course of masonry blocks, and at least one intervening course of masonry blocks between the upper and base courses, the upper, intermediate, and base courses having at least one vertically aligned and vertically extending interior cavity defining an uninterrupted vertical passage from the bottom of the upper course to the top of the base course, said upper water collection pan comprising:

a shallow pan body for redirecting a flow of water down the cavity from above the pan into the pan and for receiving said redirected flow of water, said pan body including a water receiving surface sloping downwardly from a marginal edge of the body to a drain opening at the bottom of the surface, said pan body being sized and shaped to overlie the underlying cavity, for collecting water from the overlying cavity, for preventing said received water from contacting surface of said blocks defining said overlaying and underlying cavities, and for draining said received water through the underlying.

12. An upper water collection pan according to claim 11 including a downspout extending downwardly from the drain opening.

13. An upper water collection pan according to claim 11 wherein said pan body is generally rectangular and has multiple sloping water receiving surfaces sloping to a central said drain opening, said surfaces collectively defining a pyramidally shaped pan bottom.

14. A method of preventing water penetration through and accumulation in a masonry block wall made up of multiple horizontal courses of masonry blocks including a base course, an upper course, and at least one intervening course, said courses having at least one vertically aligned interior cavity so as to create an uninterrupted vertical passage from the upper course to the base course, the method comprising the steps of:

redirecting the flow of water inside an interior cavity and receiving said redirected flow of water at the top of said upper course;

draining the water received at the upper course centrally into an underlying vertical passage and vertically through said passage to the base course;

receiving the water drained through said vertical passage at the top of said base course; and draining the water received at the top of the base course laterally via a conduit passing to the exterior of said wall.

15. The method of claim 14 wherein water is received at the top of said upper course by placing a water collection pan along said upper course vertically below a cavity above said upper course and vertically above a cavity defining the passage below the upper block course.

16. The method of claim 15 wherein received water is drained from said upper course by directing the water in the collection pan into a downspout extending into the vertical passage.

17. The method of claim 14 wherein water is received at the top of said base course by placing a base collection pan along the top of said base course at the lower end of the vertical passage.

18. A method according to claim 17 wherein water received at the base course is drained laterally from the top of said base course to the exterior of said block wall by extending a drain tube from a drain opening of said base collection pan laterally and downwardly to the outside of the wall.

* * * * *